US006062560A

United States Patent [19]

Peterson

[11] Patent Number: 6,062,560

[45] Date of Patent: May 16, 2000

[54] GAME APPARATUS AND RELATED METHODS

[75] Inventor: Paul Royes Peterson, Idaho Falls, Id.

[73] Assignee: VSM Marketing, Inc., Idaho Falls, Id.

[21] Appl. No.: 08/995,562

[22] Filed: Dec. 22, 1997

[51] Int. Cl.[7] ..... A63F 7/00

[52] U.S. Cl. ..... 273/118 R; 194/350; 232/1 D

[58] Field of Search ..... 273/108, 118 R, 273/118 A; 206/0.8, 0.81, 0.815; 232/1 R, 1 D, 4 R; 446/8, 414, 453; 194/344, 350; 52/20

[56] References Cited

U.S. PATENT DOCUMENTS

| | | | |
|---|---|---|---|
| 677,905 | 7/1901 | Tribble . | |
| 1,600,761 | 9/1926 | Haase | 52/20 X |
| 2,003,349 | 6/1935 | Dumble . | |
| 2,093,293 | 9/1937 | Stoner et al. . | |
| 2,717,683 | 9/1955 | Gallagher | 194/344 |
| 2,926,915 | 3/1960 | Johns . | |
| 3,476,391 | 11/1969 | Fejko . | |
| 4,062,435 | 12/1977 | Chalabian | 194/344 X |
| 4,651,862 | 3/1987 | Greenfield, Jr. | 194/344 |
| 4,787,873 | 11/1988 | Borrmann et al. | 446/8 |
| 5,131,655 | 7/1992 | Ugawa . | |
| 5,137,278 | 8/1992 | Schilling et al. . | |
| 5,149,093 | 9/1992 | Schilling et al. . | |
| 5,272,747 | 12/1993 | Meads | 194/344 X |
| 5,385,225 | 1/1995 | Chen et al. | 194/350 |
| 5,487,459 | 1/1996 | Farmont | 194/344 X |
| 5,516,104 | 5/1996 | Takemoto et al. . | |
| 5,722,656 | 3/1998 | Dickerson . | |
| 5,803,228 | 9/1998 | Lucas | 194/350 |

FOREIGN PATENT DOCUMENTS

| | | | |
|---|---|---|---|
| 775433 | 1/1968 | Canada | 194/350 |
| 561579 A2 | 9/1993 | European Pat. Off. | 194/350 |
| 2538025 | 3/1977 | Germany | 194/350 |
| 3730388 | 3/1989 | Germany | 194/344 |
| 40-5166043 | 7/1993 | Japan | 194/350 |
| 167377 | 8/1921 | United Kingdom | 194/350 |
| 2230371 | 10/1990 | United Kingdom | 194/350 |
| 2265745 | 10/1993 | United Kingdom | 194/350 |

*Primary Examiner*—Raleigh W. Chiu
*Attorney, Agent, or Firm*—Foster & Foster

[57] ABSTRACT

This disclosure is directed to novel systems and methods for supporting a game apparatus, actuating a paddle, and storing coins deposited in a coin-operated device. A game apparatus is disclosed for receiving coins and for storing the coins in a manner such that the theft of the coins by merely inverting the game apparatus is substantially prevented. Further, a paddle mechanism is disclosed for actuating a paddle in response to a mechanical input from a player without the need for electrically-powered sensors, solenoids, or motors. Moreover, the game apparatus is disclosed as being supported by a novel support system which enhances the stability of the table apparatus and may be conveniently assembled and disassembled.

4 Claims, 9 Drawing Sheets

165
161
40
163
194
169
166
238
167
208
200
193
164
172
189
185
181
183
187
186
184
182
170
180
188
160
176
162
174

165
163
40
161
169
208
200
238
167
166
193
164
189
185
184
183
187
182
181
172
180
186
170
176
160
188
162
174

GAME APPARATUS AND RELATED METHODS

FIELD OF THE INVENTION

The present invention relates generally to amusement systems, and, more particularly to novel structure and methods for a game apparatus.

BACKGROUND

In recent years, coin-operated amusement devices have become increasingly popular. Indeed, such amusement devices are commonly found in shopping centers, supermarkets, convenience stores, as well as in traditional arcades. Typically, conventional amusement devices require electrical motors, solenoids, sensors, or other externally-powered devices to actuate device features in response to a mechanical input from a player. As such, the vast majority of amusement devices consume power and, thus, must be located near power outlets, such as electrical receptacles.

Although traditional amusement devices have enjoyed substantial popularity in recent years, there are several problems that have yet to be adequately addressed. Many conventional game devices, such as the traditional pinball machine, are configured in a table-type orientation with a substantially horizontal table apparatus supported by four independent and discrete straight posts secured to the bottom of the table apparatus. This conventional support structure, however, has proven to be inadequate for several reasons.

First, conventional table support systems have limited stability. Due to this limited stability, conventional support systems undesirably permit the table apparatus to move while the game is being played. Further, in instances where the instability of the support system causes the table apparatus to fall, the potential for damage to the table apparatus, the support system, a player, or any other nearby individual or structure is substantially increased.

A second problem associated with conventional support systems is that they tend to be cumbersome to disassemble for transporting the game device. In circumstances where a game apparatus may need to be disassembled and reassembled frequently, conventional support systems are highly cumbersome. Accordingly, in view of the limited stability and the difficulty of disassembly, conventional support systems have proven to be largely unsatisfactory.

Further, with respect to coin-operated amusement devices (as well as non-amusement coin-operated devices) another problem exists in that the coins deposited and stored within the device coin receptacle are easily stolen by merely inverting and/or shaking the game and causing the coins to fall, by gravity, out of the coin receptacle. Any revenues collected in conventional coin receptacles are thus subject to theft or other unauthorized access by individuals who tip the device upside down and/or vigorously shake the device to cause the coins to fall out of the receptacle. Hence, traditional coin receptacles have failed to provide theft prevention structure and methods which are both effective and cost-justified.

BRIEF SUMMARY AND OBJECTS OF THE INVENTION

In brief summary, the present invention overcomes or substantially alleviates prior art problems related to the provision of a coin-operated amusement device. The present invention provides novel structure and methods for supporting the game device, operating the game device, and preventing theft of the coins received.

With the foregoing in mind, it is a primary object of the invention to overcome or substantially alleviate the problems associated with prior art amusement devices.

Another object of importance is the provision of a system for actuating a amusement device feature, such as a paddle, without requiring electric motors, solenoids, sensors, or other devices in response to a mechanical input from a player.

A further paramount object is the provision of a support system which allows for convenient disassembly and reassembly to facilitate transporting the system from one location to another.

It is an object of considerable value to provide a support system with enhanced stability to prevent undesired movement of the support system and the collapse of the support system.

It is a dominant object to provide a system and method of receiving and storing coins in a coin-operated device in such a manner that the theft of the coins by merely inverting the device is substantially prevented.

It is another object of significance to provide a system and method of preventing theft of coins stored in a coin-operated device in an effective and cost-justified manner.

These and other objects and features of the present invention will be apparent from the detailed description taken with reference to the accompanying drawings.

DETAILED DESCRIPTION OF THE ILLUSTRATED EMBODIMENTS

Figure 1:
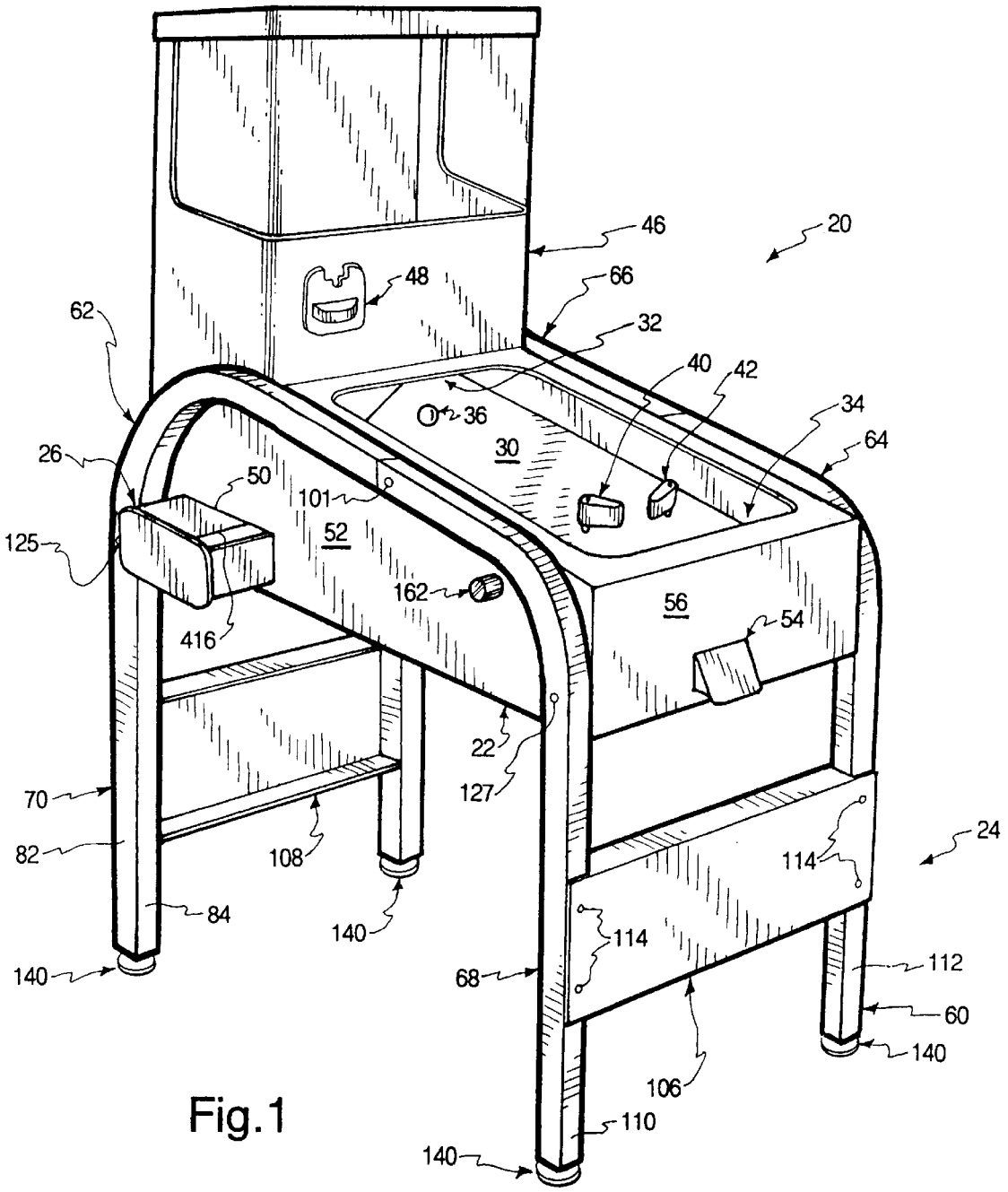
FIG. 1 is a perspective view of a game apparatus according to the principles of the present invention.
Figure 2:
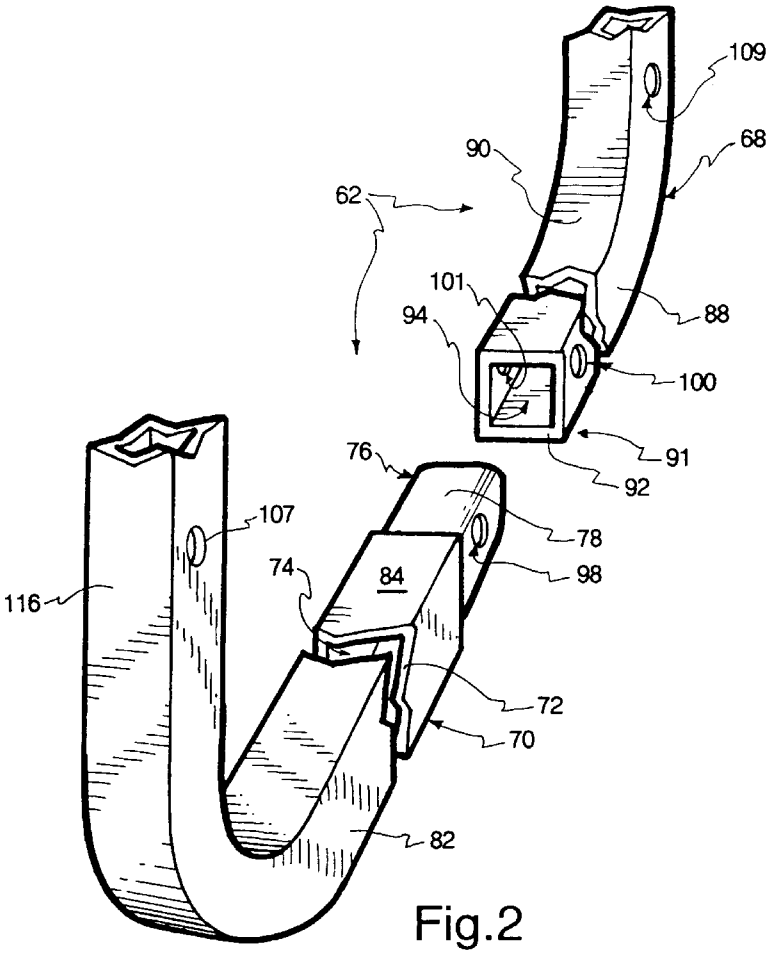
FIG. 2 is a perspective breakaway view of the support system of the game apparatus of FIG. 1.
Figure 12:
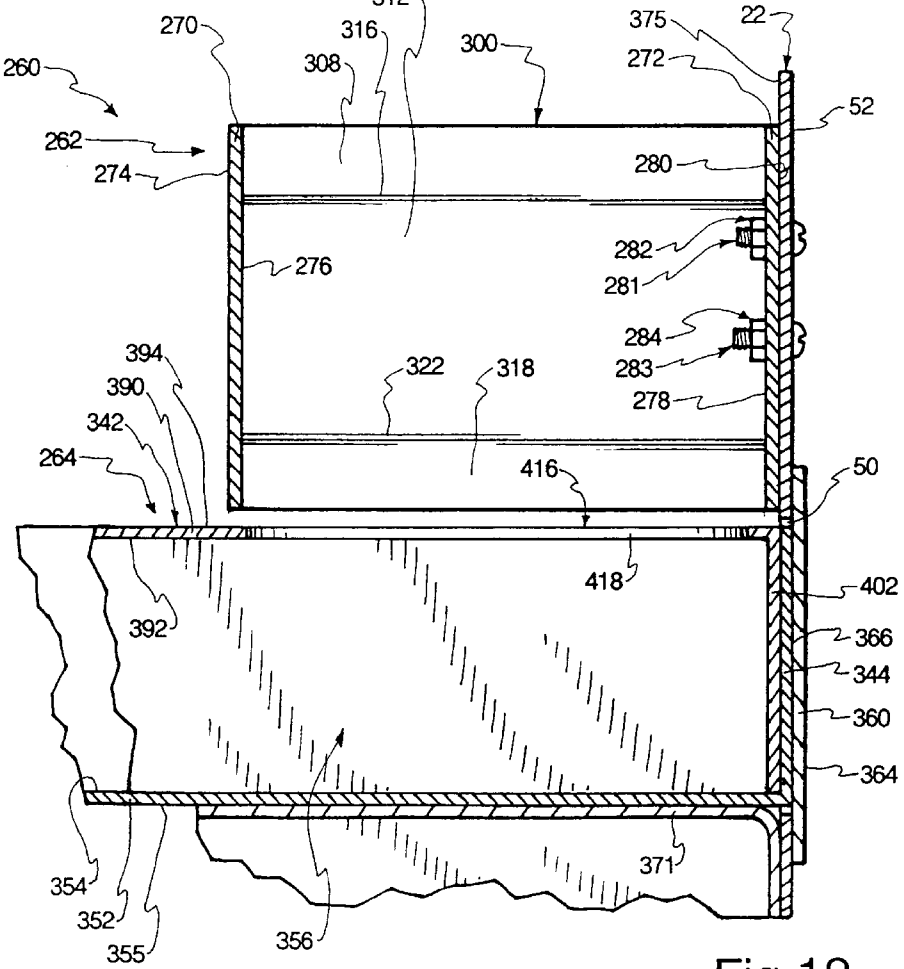
FIG. 12 is a side sectional elevation view taken along the line 12—12 of FIG. 10.
Figure 5:
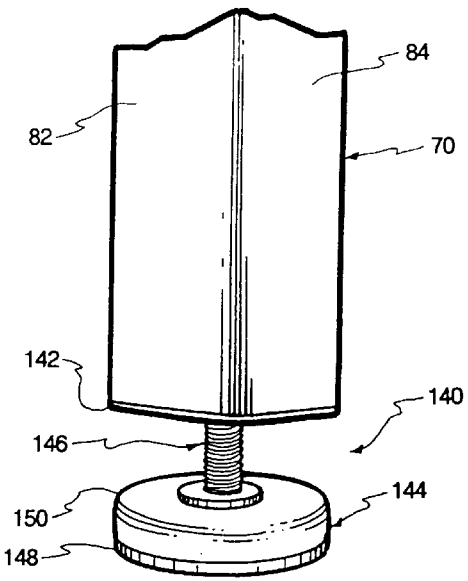
FIG. 5 is a perspective view of a foot assembly used with the game apparatus of FIG. 1.
Figure 4:
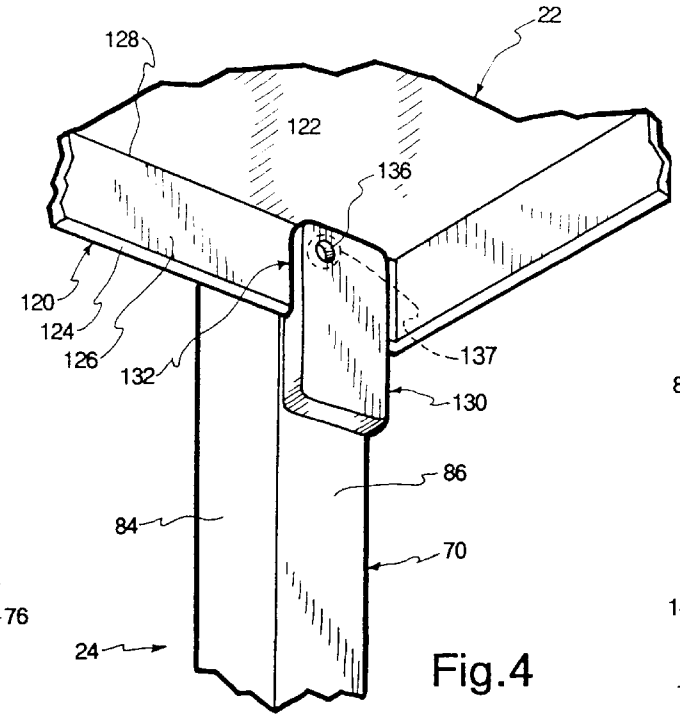
FIG. 4 is a perspective view of a support structure of the game apparatus of FIG. 1.
Figure 3:
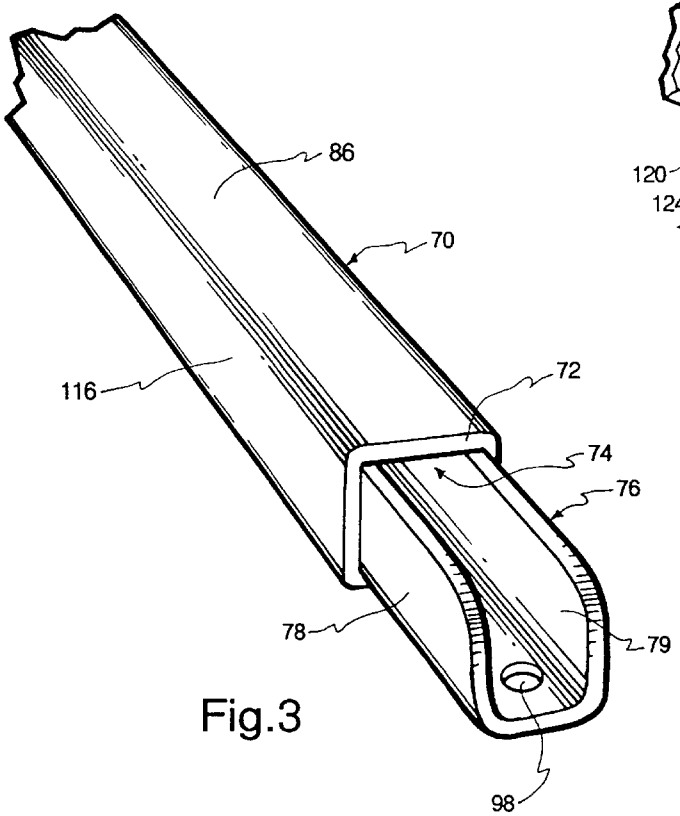
FIG. 3 is a breakaway perspective of a support structure member of FIG. 1.
Figure 4A:
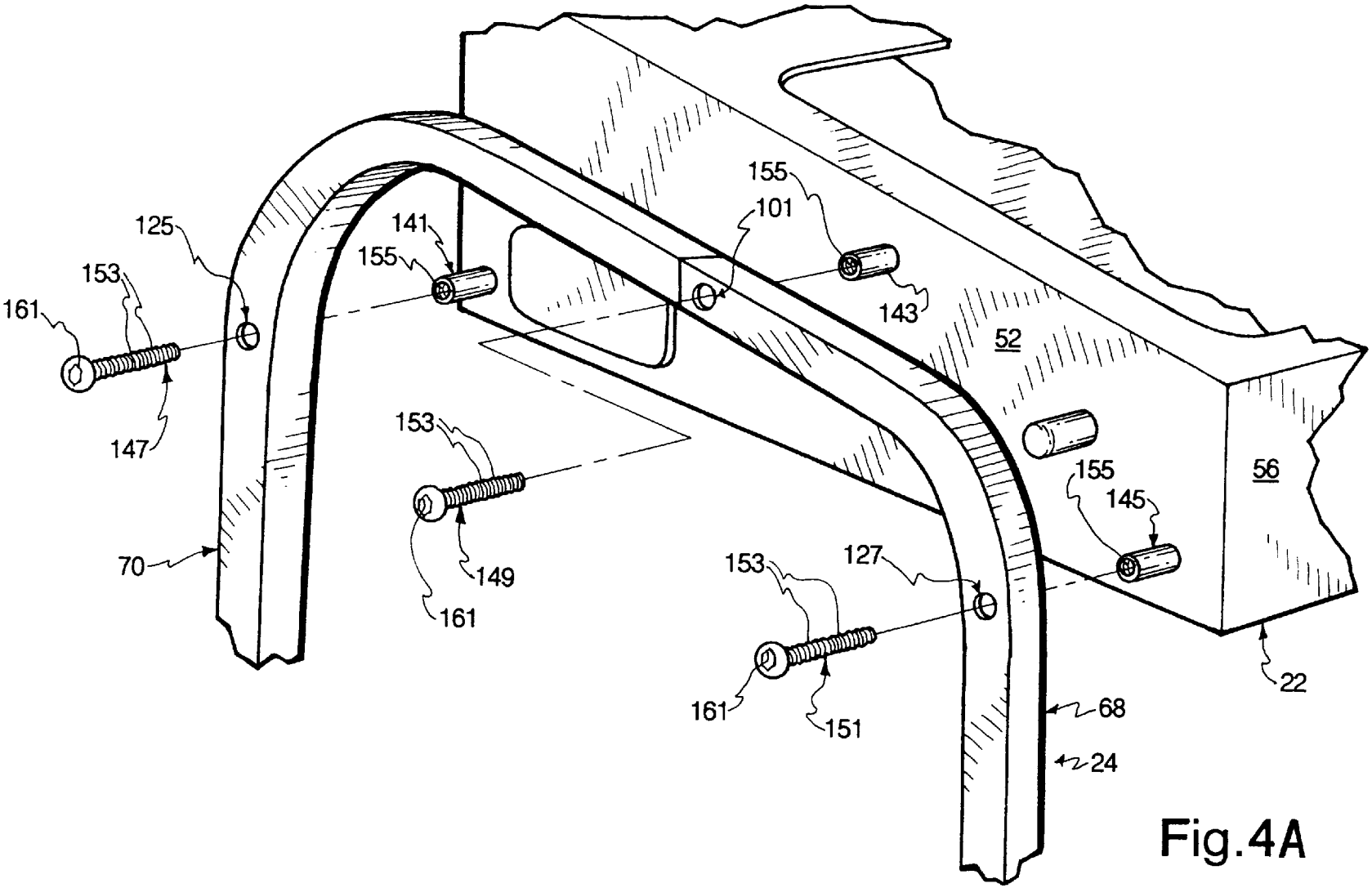
FIG. 4A is a perspective view of an alternate support structure of the game apparatus of FIG. 1.
Figure 6:
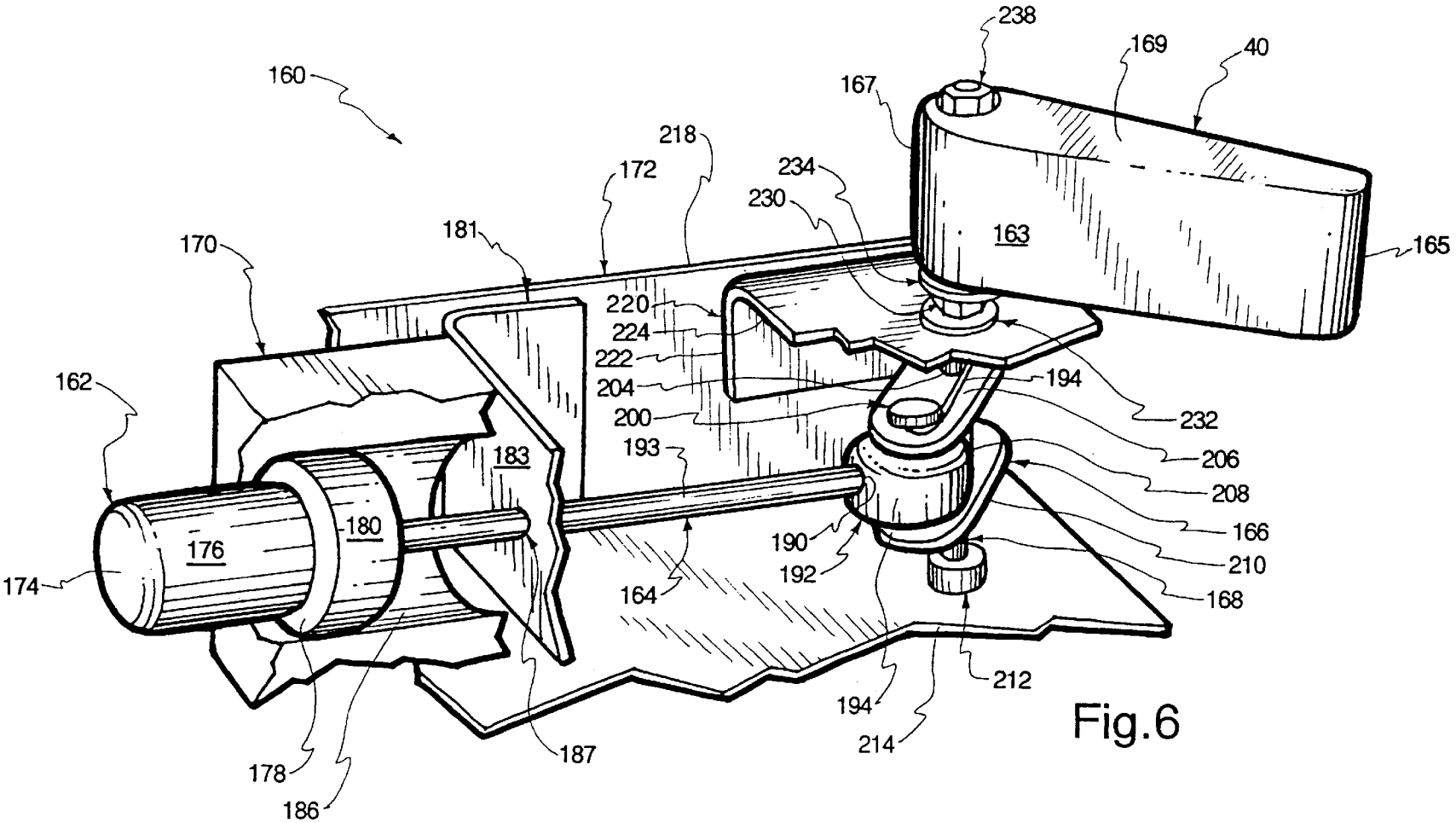
FIG. 6 is a perspective of a paddle assembly used in the game apparatus of FIG. 1.
Figure 7:
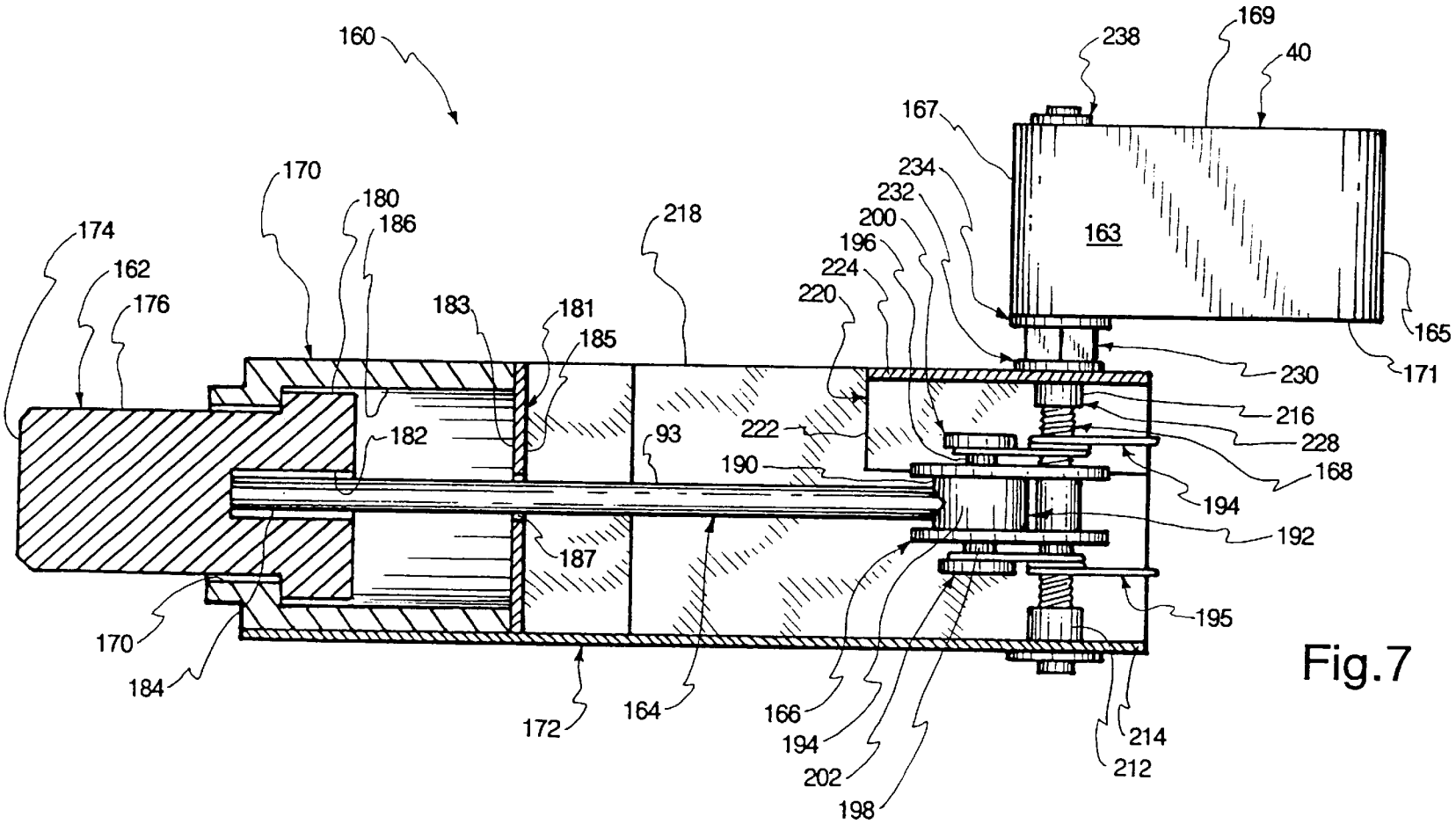
FIG. 7 is a sectional elevation view of a paddle assembly used in the game apparatus of FIG. 1.
Figure 8:
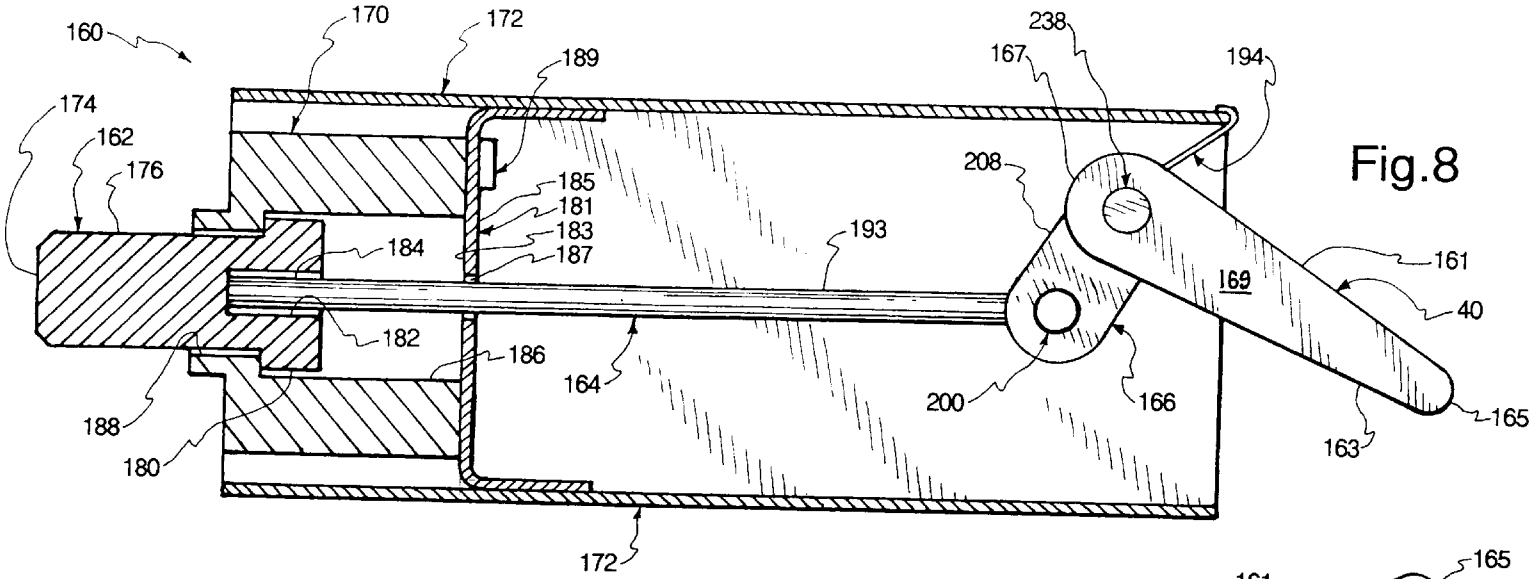
FIG. 8 is a sectional plan view of a paddle assembly used in the game apparatus of FIG. 1 in a retracted position.
Figure 9:
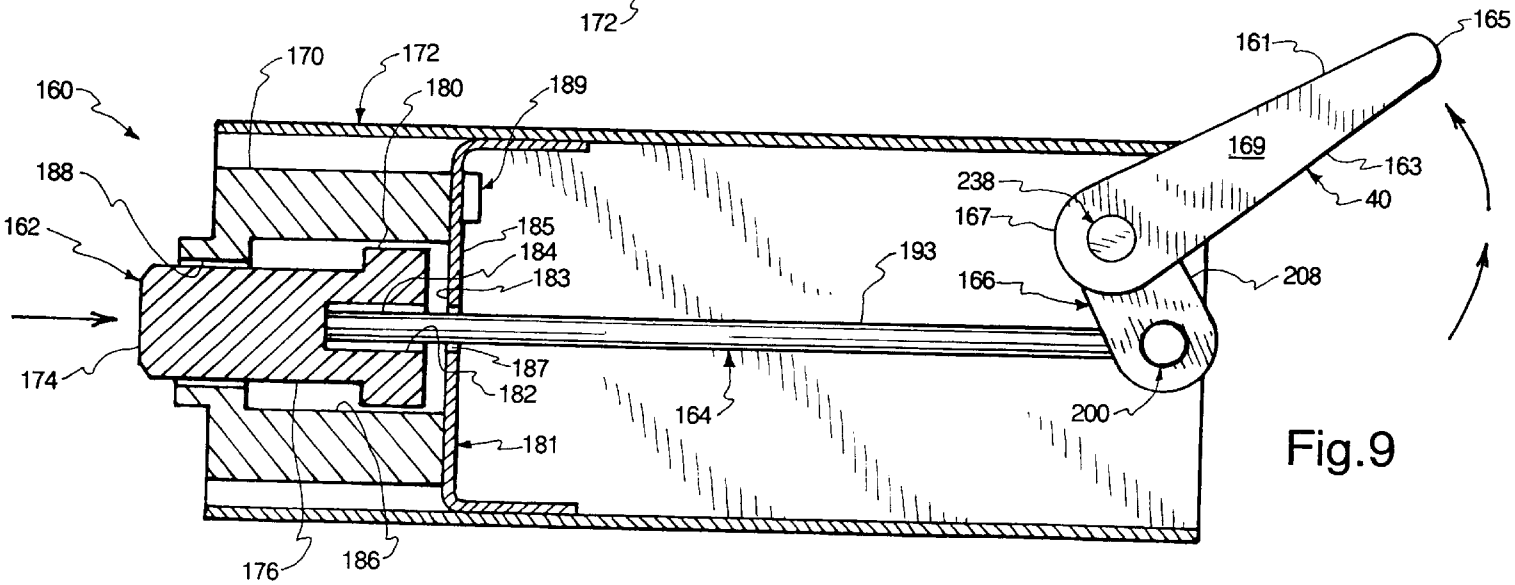
FIG. 9 is a sectional plan view of a paddle assembly used in the game apparatus of FIG. 1 in an extended position.
Figure 11:
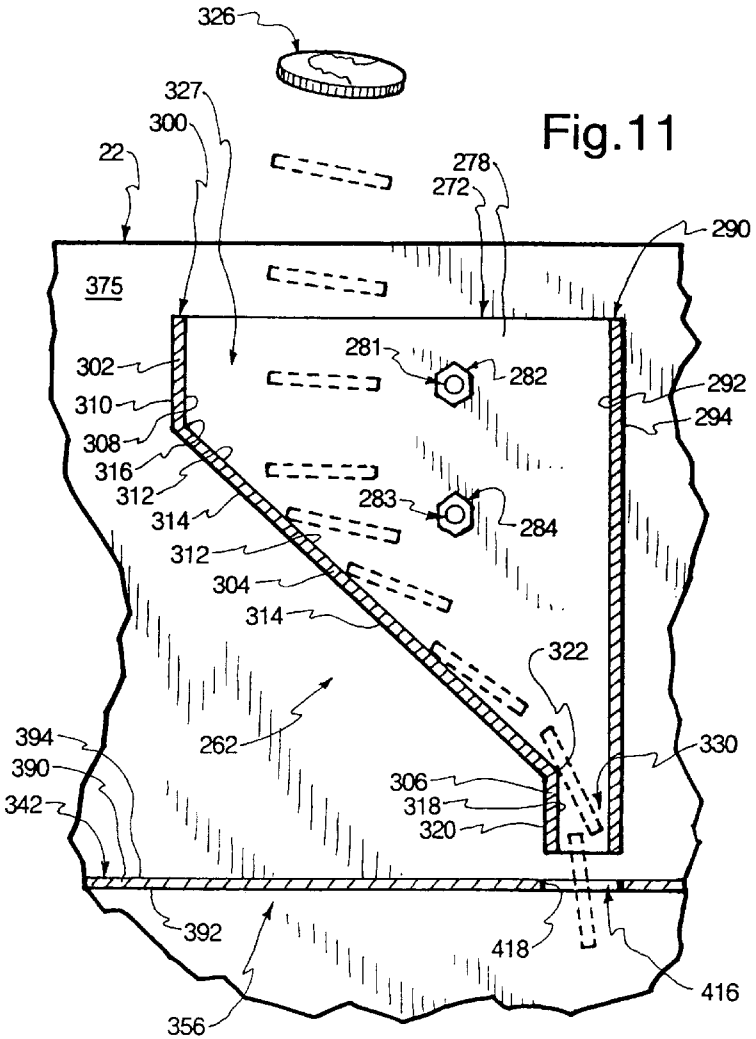
FIG. 11 is a side sectional elevation view of the coin receptacle assembly taken along the line 11—11 of FIG. 10.
Figure 10:
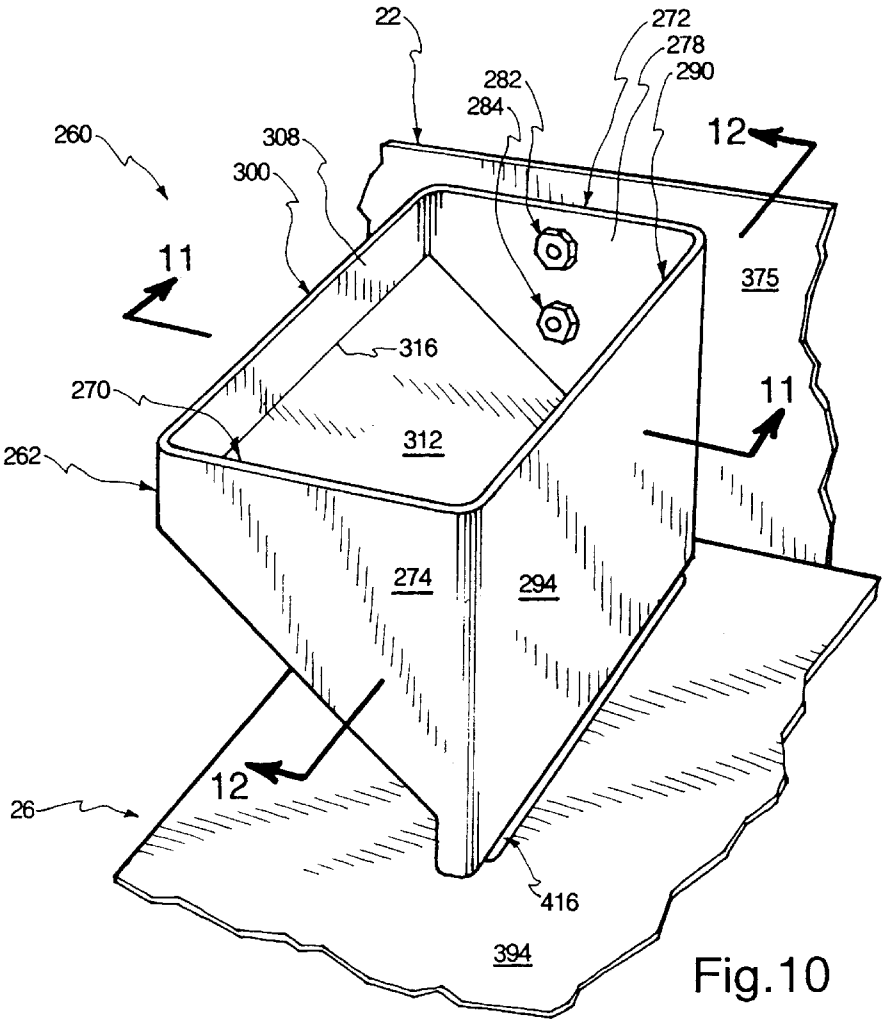
FIG. 10 is a perspective of a coin receptacle assembly used in the game apparatus of FIG. 1.
Figure 13:
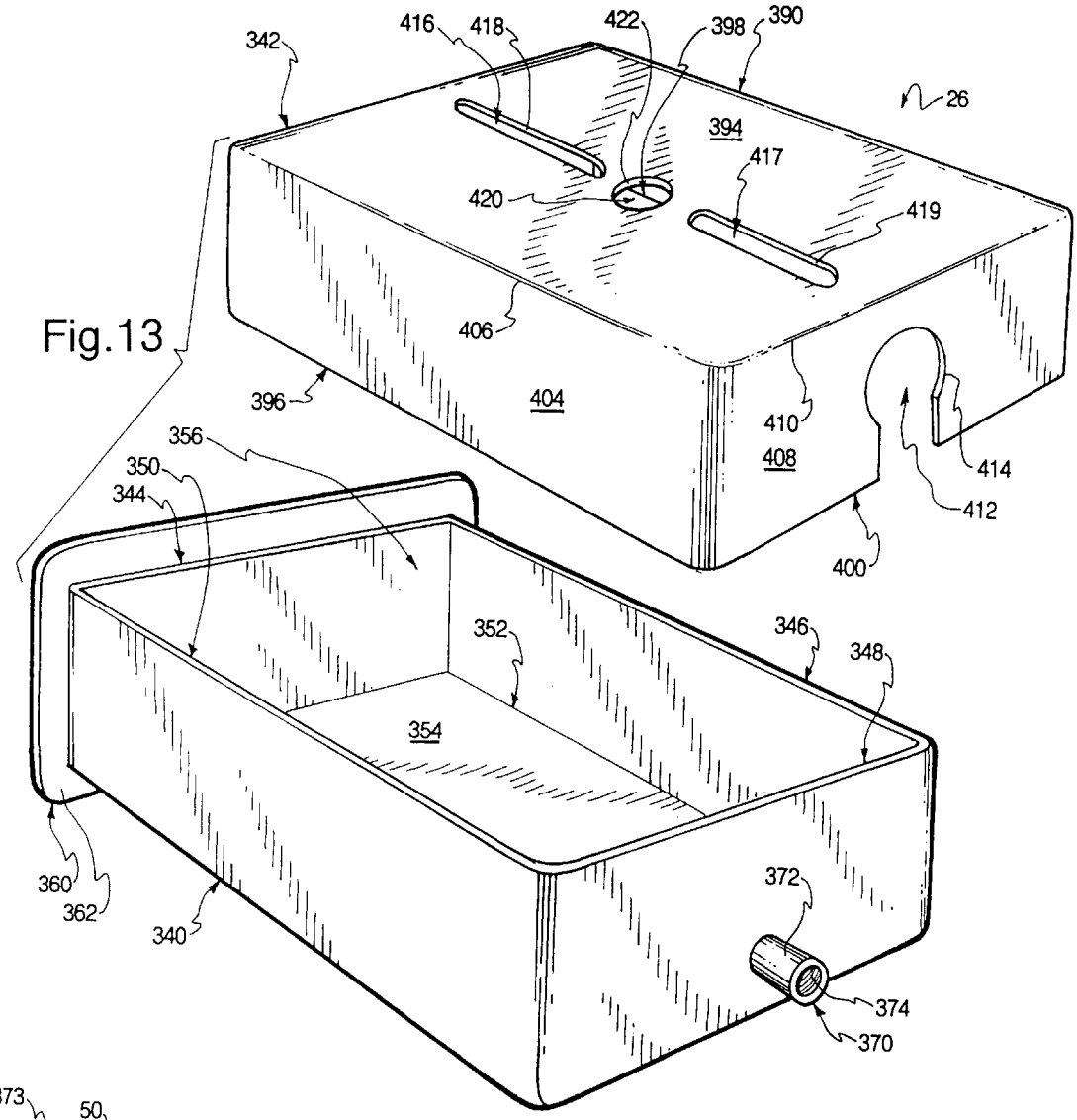
FIG. 13 is a perspective view of the coin receptacle apparatus of the coin receptacle assembly of FIG. 10.
Figure 14:
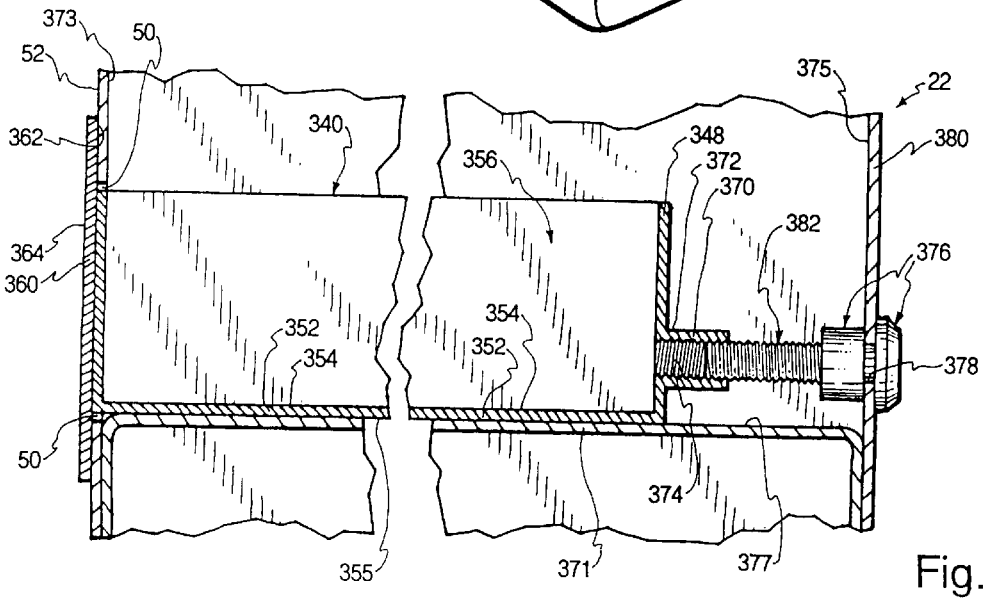
FIG. 14 is a sectional elevation view of the coin receptacle apparatus of FIG. 13.

Reference is now made to the drawings where like numerals are used to designate like parts throughout. FIG. 1 illustrates a game apparatus according to the principles, methods, and structures of the present invention. FIG. 2 illustrates elements of the support system in a disassembled condition. FIG. 3 illustrates the male end of a support system element. FIG. 4 illustrates the interconnection between the table apparatus and the support system. FIG. 4A illustrates an alternate interconnection between the table apparatus and the support system. FIG. 5 illustrates a foot assembly of the support system. FIG. 6 illustrates a paddle assembly according to the present invention. FIG. 7 illustrates a side elevation view of the paddle assembly. FIG. 8 illustrates the paddle assembly in a retracted position. FIG. 9 illustrates the paddle assembly in an extended position. FIG. 10 illustrates a coin receptacle assembly according to the present invention. FIG. 11 is a sectional view of the coin receptacle assembly and illustrates the function of an alignment conduit according to the present invention. FIG. 12 illustrates the coin receptacle assembly of FIG. 10 in a cross-sectional view. FIG. 13 illustrates a coin receptacle assembly according to the present invention. FIG. 14 illustrates the coin receptacle assembly of FIG. 13 secured within the game apparatus.

As shown in FIG. 1, a game apparatus 20 is shown as generally comprising a table apparatus 22, a support system 24, and a coin receptacle assembly 26. The table apparatus 22 is illustrated as further comprising an inclined playing surface 30, the inclined playing surface comprising an elevated end 32 and a lower end 34. The inclined surface 30 allows a spherical object 36 to roll along the inclined surface, by gravity, from the elevated end 32 to the lower end 34. In one embodiment, the spherical object 36 may comprise a conventional gum ball. Further, paddles 40 and 42 are rotatably positioned on the inclined surface 34 to selectively strike the spherical object 36 according to a mechanical input from a player (not shown) to a knob 162. The purpose and function of the knob 162 and of the paddles 40 and 42 are discussed more fully below.

The table apparatus 22 further comprises a vertically directed rectangular housing 46 which further comprises a conventional coin mechanism 48. The housing 46 may serve a variety of purposes, such as, for example, providing a mounting location for a game display or providing a place to store game rewards.

An aperture 50 is formed in the table apparatus side wall surface 52 for slidably receiving the coin receptacle assembly 26 within the table apparatus 22. The purpose and function of the coin receptacle 26 is discussed in more detail below. A conventional dispensing output 54 is positioned on a table apparatus front wall surface 56 for discharging a game reward from the game apparatus 20 to a player (not shown).

The table apparatus 22 is supported by the support system 24. The support system 24 is illustrated as generally comprising two U-shaped members 60 and 62. The U-shaped member 60 is illustrated as comprising a curved front leg 64 and a curved rear leg 66. Likewise, the U-shaped member 62 comprises a curved front leg 68 and a curved rear leg 70. As illustrated in FIG. 2, the front leg 68 and the rear leg 70 engage one another to form the U-shaped member 62. The front leg 68 comprises a female member and the rear leg 70 comprises a male member.

The rear leg 70 is shown as comprising a rectangular tube 72 defining a hollow interior 74. A curved arm 76 comprising an exterior surface 78 and an interior surface 79 is securely mounted within the hollow interior 74 of the rectangular tube 72. The rear leg 70 further comprises an outside surface 82, a front surface 84, and a inner surface 86 (FIG. 4). Similarly, the front leg 68 comprises a rectangular tube comprising an inside surface 88 and a bottom surface 90. The front leg 68 terminates at an engaging end 91 with a transverse surface 92. A front leg hollow interior 94 is defined by the inner surfaces of the rectangular tube 68 and is sized to tightly receive the arm 76 of the rear leg 70.

As illustrated, the arm 76 may be securely engaged and positioned within the hollow interior 94 of the front leg 68. The arm 76 is dimensioned so as to create a tight or a press-fit attachment between the exterior surface 78 of the arm 76 and the inner surfaces of the front leg hollow interior 94. Further, as illustrated in FIGS. 2 and 3, the arm 76 further comprises an aperture 98 and the front leg 68 further comprises apertures 100 and 101 to permit a conventional fastener to be passed through the apertures 98, 100 and 101 to further secure the arm 76 of the rear leg 70 within the hollow interior 94 of the front leg 68. That is, when the arm 76 is fully engaged within the interior 94 of the leg 68, aperture 98 is aligned with apertures 100 and 101 to permit a fastener to be passed through the apertures 98, 100 and 101 to further secure the arm 76 within the interior 94 of the leg 68. Advantageously, the aperture 101 has a greater diameter than that of the aperture 100. The rear leg 66 and the front leg 64 of the U-shaped member 60 are configured in a manner identical to that of rear leg 62 and 68 respectively.

Additionally, as shown in FIG. 2, apertures 107 and 109 are respectively formed in the leg surfaces 82 and 88. The apertures 107 and 109 are aligned with the apertures 125 and 127 shown in FIG. 4A.

A front transverse support member 106 and a rear transverse support member 108 are provided to enhance the stability of the support system 24. As shown, the front transverse support 106 is illustrated as being secured to a front surface 110 of the front leg 68 and to a front surface 112 of the front leg 64. The transverse support member 106 is illustrated as being fastened to the surfaces 110 and 112 by conventional fasteners 114. In a similar manner, the transverse support member 108 is secured to a rear surface 116 of the rear leg 70 and to a rear surface (not shown) of the rear leg 66 with conventional fasteners.

FIG. 4 illustrates the manner in which the table apparatus 22 is mounted on and secured to the support system 24. As shown, the table apparatus 22 comprises a flange 120 vertically directed and mounted on a bottom surface 122 of the table apparatus 22. The flange 120 comprises a bottom surface 124 and a vertically-directed surface side 126 which intersects the table apparatus bottom surface 122 along an edge 128.

A plate 130 is rigidly secured to the inside surface 86 of the rear leg 70 in a conventional manner, such as by welding. A slot 132 is formed between the plate 130 and the wall surface 86 of the support member 70. The slot 132 is sized to permit the flange 120 to be positioned within the slot and to be secured by the plate 130. A fastener, such as a set screw 137, may be passed through an aperture 136 formed in the plate 130 to further secure the flange 120 within the slot 132. Plates identical to the plate 130 are also secured to the front leg 68, the rear leg 66, and the front leg 64 for securing the table apparatus to the front leg 68, the rear leg 66, and the front leg 64.

FIG. 4A illustrates an alternate manner of interconnection between the table apparatus 22 and the support system 24. As shown, in this embodiment, three annular bosses 141, 143, and 145 are rigidly mounted on the exterior surface 52 of the table apparatus 22. The bosses 141, 143, and 145 are inserted into the apertures 107, 100, and 109 (FIG. 2). With the bosses 141, 143, and 145 positioned respectively within the apertures 107, 100, and 109, threaded fasteners 147, 149, 151 are passed through the apertures 125, 100, and 127 and are secured within the bosses 141, 143, and 145. As illustrated, each fastener 147, 149, and 151 further comprises a hex head 161 and external threads 153 which engage with internal threads 155 formed on an inside surface of each annular boss 141, 143, and 145.

FIG. 5 illustrates a foot assembly 140 positioned at a bottom end 142 of the rear leg 70. The foot assembly 140 comprises a foot 144 rigidly attached to a shaft 146. The shaft 146 is secured within the rear leg 70 at the bottom end 142. As shown, the foot 144 comprises a base 148 and a cover 150. Advantageously, the base 148 may be formed of plastic so as to provide both slip resistance and protection to the surface, such as a floor (not shown), on which the game apparatus 20 is placed. The cover 50 is illustrated as being rigidly attached to the base 148 and to the shaft 146. The shaft 146 is shown as comprising a threaded member which may be selectively threaded into the rear leg 70 of the U-shaped member 62. By selectively advancing the shaft 146 relative to the bottom end 142 of the rear leg 70, the height of the foot assembly 140 may be selectively varied to provide enhanced stability to the support system 24 and to accommodate floor surfaces which may be uneven. As shown in FIG. 1, foot assemblies 140 identical to the foot assembly 140 illustrated in FIG. 5 are attached to the bottom ends of the front leg 68, the rear leg 66, and the front leg 64.

FIGS. 6–9 illustrate a paddle assembly 160 according to the present invention. The paddle assembly 160 is shown as generally comprising a knob 162, a shaft 164, a pivot arm 166, a post 168 (FIG. 7), and the paddle 40. In general, the paddle 40 is caused to move from a retracted position illustrated in FIG. 8 to an extended position illustrated in FIG. 9 by advancing the knob 162 relative to a block 170 secured within a paddle assembly housing 172.

The paddle 40 is shown as comprising a front surface 161, a rear surface 163, a rounded tip 165, and rounded base 167. The paddle 40 further comprises a top surface 169 and a bottom surface 171. In the illustrated embodiment, the spherical object 36 may be struck by the front surface 161 of the paddle 40.

Further, the knob 162 is illustrated as comprising an end surface 174, a substantially cylindrical surface 176, a transverse surface 178, and a large cylindrical surface 180. A bore 182 is formed within the knob 162 to receive a first end 184 of the shaft 164. In one embodiment, the shaft end 184 is slidably positioned within the bore 182. However, it is appreciated that the paddle assembly 160 would also perform its function effectively with the shaft end 184 rigidly secured within the bore 182.

The large cylindrical surface 180 is illustrated as having a greater diameter than the cylindrical surface 176 and is slidably coupled with an inside surface 186 of the block 170. Likewise, the smaller diameter surface 176 of the knob 162 is slidably positioned within a small diameter bore 188 of the block 170. In this configuration, the knob 162 may freely slide longitudinally relative to the block 170 to impart translational motion to the shaft 164.

A brace 181 having an outside surface 183 and an inside surface 185 is secured within the housing 172. An aperture 187 is formed through the brace 181 to permit the shaft 164 to pass therethrough. The block 170 is secured via a fastener 189 to the brace 181 to secure the block 170 within the housing 172.

A shaft driving end 190 is rigidly and non-rotatably attached to a disk 192. A shaft external surface 193 intersects an external disk surface 194 at the disk driving end 192. The disk 192 is pivotally attached to the pivot arm 166 by a pivot 196 (FIG. 7). The pivot 196 comprises a shaft 198 interposed between a top restraint 200 and a bottom restraint 202. The pivot shaft 198 is illustrated as passing through an aperture formed in the arm 166 and through an aperture formed in the disk 192. In this configuration, as the knob 162 is advanced into the block 170, the shaft 164, in turn, advances the disk 192 longitudinally.

The arm 166 is, as described above, rotatably coupled at one end with the disk 192 by the pivot shaft 198. The arm 166 is further rigidly, and non-rotatably, attached to the post 168. As illustrated in FIG. 6, the post 168 passes through an aperture 204 formed in an arm top member 206 and through an aperture 208 formed in an arm lower member 210.

The post 168 is rotatably mounted within the housing 172. A lower end of the post 168 is pivotally secured within a bottom wall 214 via a bearing 212. Likewise, a top end 216 of the post 168 is pivotally secured to an L-shaped bracket 220 by a bearing 232. The L-shaped bracket 220 comprises a vertically directed portion 222 attached to the wall 218 and a horizontally directed portion 224. A fastener 230 is positioned about the post 168 between the bearing 232 and a disk 234 to secure the paddle 40 to the post 168 in a non-rotatable manner. As shown in FIG. 7, the post 168 may comprise a threaded member to permit threaded fasteners, such as 230 and 238 to be threadedly secured to the post 168.

In this configuration, as the knob 162 is advanced from the position illustrated in FIG. 8 to the position illustrated in FIG. 9, the shaft 164 drives the disk 192 to rotate the post 168 relative to the housing 172. The rotation of the post 168 causes the paddle 40 to also rotate since the paddle 40 is non-rotatably attached to the post 168. Hence, a user may cause the paddle 40 to strike a spherical object, such as the spherical object 36 (FIG. 1) by providing a mechanical input, such as pressing the knob 162 from the position illustrated in FIG. 8 to the position illustrated in FIG. 9.

Bias members, such as springs 194 and 195 (FIG. 7), are coupled to the arm 166 to bias the paddle 40 in the retracted position illustrated in FIG. 8. As shown, each spring comprises a length of spring wire wrapped around the post 168 and attached to the housing 172 at one end and attached to the arm 166 at the other end. The bias of the springs 194 and 195 may be selectively overcome by advancing the knob 162 from the position shown in FIG. 8 to the position shown in FIG. 9.

The paddle 42 is also caused to selectively pivot by actuation of a paddle assembly identical to the paddle assembly 160 described above and illustrated in FIGS. 6 through 9.

FIGS. 10–14 illustrate a coin receiving assembly 260 according to the present invention. The coin receiving assembly 260 (FIG. 10) is illustrated as generally comprising an alignment conduit 262 and a coin storage assembly 26. As shown, the alignment conduit 262 comprises two substantially parallel side walls 270 and 272. The wall 270 further comprises an outside surface 274 and an inside surface 276 (FIG. 12). Similarly, the side wall 272 comprises an inside surface 278 and an exterior surface 280. The alignment conduit 262 is illustrated as being secured to the table apparatus 22 by threaded shafts 281 and 283 mounted on the wall surface 375 and conventional threaded fasteners 282 and 284.

A vertical wall 290 is illustrated as being formed as one piece with the side walls 270 and 272 and as comprising an inside surface 292 and an outside surface 294. The vertical wall 290 is also illustrated as being flat and as being oriented in a substantially perpendicular relationship with the side walls 270 and 272.

The alignment conduit 262 is further illustrated as comprising a wall 300. The wall 300 is illustrated in FIG. 11 as comprising a top vertical portion 302, a sloped portion 304, and a second vertical portion 306. The first vertical wall portion 302 comprises an inner surface 308 and an outer surface 310. Similarly, the sloped portion 304 further comprises an inside surface 312 and an outer surface 314. The inside surfaces 308 and 312 intersect along an edge 316. The bottom vertical portion 306, likewise, comprises an inside surface 318 and an outer surface 320. The inside surface 318 and the inside surface 312 intersect along an edge 322.

As a coin 326 is passed through the alignment conduit 262, the coin 260 is aligned to a substantially vertical orientation. As shown in FIG. 11, as the coin 326 contacts the inclined surface 312, the coin 326 is gradually vertically oriented prior to being discharged from the alignment conduit 262 through a narrow channel 330 defined by the inside surface 318 and the lower portion of inside surface 292. Advantageously, the width of the channel 330 is less than about 0.25 inches, and preferably has a width on the order of 3/16ths of an inch. By orienting the coin 326 in a substantially vertical manner, the coin 326 may be deposited within the box 340 through an elongated aperture 416 as discussed in more detail below. In the unlikely event a coin 326 becomes lodged within or adjacent to the channel 330, subsequent coins passed through the alignment conduit 262 will collide with and dislodge the lodged coin.

The coin storage container 26 is illustrated in FIGS. 1, 10, 11, 12, 13, and 14. In general, the coin storage container 26 comprises the box 340 and an insert 342. The box 340 is illustrated as comprising four vertically directed side walls 344, 346, 348, and 350. As shown, the vertical walls 344 and 348 are substantially parallel with one another and are substantially perpendicular to the walls 346 and 350. A box floor 352 comprising a top surface 354 and a bottom surface 355 forms a bottom to the box 340. A box chamber 356 is defined by the walls 344, 346, 348, 350, and the floor 352. A face plate 360 comprises a back surface 362 and a front surface 364 (FIG. 14). The rear surface 362 of the plate 360 is removably lightly affixed to an outside surface 366 of the wall 344.

In one embodiment, the face plate of box 340 is removably or lightly secured, such as by welding, to the wall 344 of the box 340. By lightly securing the face plate 360 to the box 340 permits the face plate 360 to become disconnected from the box 340 in the event an individual, such as a thief, attempts to remove the coin box 340 from the table apparatus 22 by prying the face plate 360 against the wall surface 52. Thus, as a thief attempts to pry the box 340 out of the table apparatus 22 by prying the face plate 360 against the wall surface 52, the face plate becomes disconnected from the box 340 and the thief is left with nothing to pry against. Importantly, by only securing the face plate lightly to the box 340, the coin box, when locked within the table apparatus 22 as illustrated in FIG. 14 may not be removed through the aperture 50 by prying the face plate against the wall surface 52.

As shown in FIG. 14, to secure the box 340 within the table apparatus 22, an annular boss 370 having an exterior surface 372 and a threaded interior surface 374 is shown as being formed as one piece with the wall 348 of the box 340. A conventional lock 376 is secured within an aperture 378 formed through a side wall 380 of the table apparatus 22. A threaded shaft 382 is coupled with the locking mechanism 376 so that the shaft 382 may be selectively rotated relative to the annular boss 370. As illustrated in FIG. 14, the threaded shaft 382 is engaged with the threaded interior surface 374 of the boss 370. In this configuration, the box 340 is secured within the table apparatus 22 to prevent unauthorized access to the box 340.

A brace 371 is secured within the table apparatus 22 to provide vertical support to the box 340. As shown, the brace 371 is secured between inside wall surfaces 373 and 375 of the table apparatus 22. The box bottom surface 355 is slidably positioned on a top surface 377 of the brace 371.

To access the box 340, the locking mechanism 376 is actuated to rotate the shaft 382 to withdraw the threaded shaft 382 from within the annular boss 370. With the threaded shaft removed from within the annular boss 370, the box 340 may be removed from within the table apparatus 22 by sliding the box 340 along the brace top surface 377 and through the aperture 50 formed in the table apparatus wall 52.

A cover 342 is illustrated as comprising a top wall 390 having an inside surface 392 and an exterior surface 394. The cover 342 also comprises four vertically directed walls 396, 398, 400, and 402. The top surface 394 of the cover 342 intersects with a side exterior surface 404 of the wall 396 along a corner 406. Likewise, the top surface 394 intersects a rear outside surface 408 of the wall 400 along a comer 410. The cover 342 is sized so as to tightly fit within the chamber 356 of the box 340 as illustrated in FIG. 12. To prevent any interference between the cover 342 and the boss 370, an opening 412 is formed in the rear wall 400 and is defined by an inside edge 414.

To permit a substantially vertically oriented coin to enter the chamber 356 of the box 340, a narrow, elongated aperture 416 is formed within the wall 390 of the cover 342 and is defined by an edge 418. While the width of the aperture 416 should generally be less than about 0.3 inches, it has been found, that in some applications, an elongated aperture width of approximately 3/16ths of an inch is satisfactory.

A finger hole 420 defined by an annular edge 422 is also formed in the wall 390 to provide a gripping location to allow convenient withdrawal of the cover 342 from within the box 340. In general, the diameter of the finger hole 420 should be large enough to permit a user to insert a finger into the hole 420. Additionally, the hole 420 should have a diameter smaller than the diameter of the coin 326 to prevent the coin 326 from passing through the hole 340. In one embodiment, it has been found that a hole diameter of approximately 7/8ths of an inch for the hole 420 is satisfactory.

The cover further comprises a second elongated aperture 417 formed within the wall 390 of the cover 342 and defined by an edge 419. The elongated aperture 417 is sized and configured in a manner identical to that of the elongated aperture 416. By having an elongated aperture on both sides of the top surface 394, the coin receiving assembly 260 may function satisfactorily regardless of whether the aperture 416 is positioned adjacent to the front wall 344 or adjacent to the rear wall 348. In instances where the aperture 416 is positioned adjacent to the rear wall 348, coins may enter the coin box in a substantially vertical manner through the elongated aperture 417.

In operation, a coin 326 is deposited in the game apparatus 20 through a conventional coin mechanism 48 (FIG.

1). The coin 326 then passes, as illustrated in FIG. 11, by gravity, into the wide end 327 of an alignment conduit 262. As the coin passes through the alignment conduit 262, by virtue of the inclined surface 312, the alignment conduit 262 orients the coin 326 vertically. Once the coin 326 is substantially vertically oriented, the coin is discharged through the output 330 of the alignment conduit 262 in a substantially vertical manner. The vertically oriented coin 326 then passes through the elongated aperture 416 into the chamber 356 to be stored. Because the width of the aperture 416 is substantially less than the diameter of the coin 326, the coin 326 may only pass through the aperture 416 in a substantially vertical orientation. As such, the only way to pass a coin 326 through the aperture 416 is to orient the coin in a substantially vertical manner. Thus, it is highly unlikely that coins stored within the chamber 356 of the box 340 may be removed from the chamber 356 by merely inverting the box 340 because of the narrow diameter of the aperture 416. In essence, to remove a coin from the coin box through the aperture 416, the coin would first have to be substantially vertically oriented.

In the unlikely event that a coin 326 becomes lodged within or adjacent to the output 330, the lodged coin may be easily dislodged by passing another coin through the alignment conduit. Thus, any coins that become lodged within the alignment conduit are dislodged as subsequent coins are passed through the alignment conduit.

To properly access coins deposited within the chamber 356 of the box 340, the lock mechanism 376 is actuated to withdraw the threaded shaft 382 from within the threaded annular boss 370. With the threaded shaft 382 removed from within the annular boss 370, the box 340 and the cover 342 may be removed from within the table apparatus 22 by sliding the box 340 and the cover 342 through the aperture 50 formed in the wall surface 52. Once the box 340 and the cover 342 are withdrawn from within the table apparatus 22, the cover may be removed from within the box 342 by inserting a finger, or other structure, into the finger hole 420 and lifting the cover 342 out of box 340. With the cover 342 removed from within the box 340, any coins deposited within the box 356 may be accessed and, if desired, removed.

After a coin is deposited within the game apparatus 20 as described above, the spherical object 36 is discharged and permitted to roll along the inclined surface 30 from the elevated end 32 to the lower end 34. In one embodiment, the spherical object 36 comprises a conventional gum ball, such as a gum ball having a diameter of approximately one inch. As the spherical object 36 rolls along the inclined surface 30, the spherical object 36 may be struck by actuation of the paddles 40 and 42. The actuation of the paddle 40 from the retracted position illustrated in FIG. 8 to the extended position illustrated in FIG. 9, is accomplished by providing a mechanical input, such as by advancing the knob 162 relative to the housing 172. Specifically, as the knob 162 is advanced within the block 170, the shaft 164 imparts translational motion to the disk 192. The translational motion of the disk 192, in turn, imparts rotational movement to the post 168 via the arm 166. The paddle 40 is rigidly and non-rotatably attached to the post 168 and thus, the paddle 40 is caused to pivot by the rotation of the post 168. Bias members 195 and 197 are coupled to the arm 166 to bias the paddle 40 in the retracted position illustrated in FIG. 8. The paddle 42 may also be actuated to strike the spherical object 36 pursuant to the same process by which the paddle 40 is attached.

At the conclusion of a game plate on the game apparatus 20, a reward, such as a gum ball, may be discharged to the player through the discharge 54 formed on the exterior surface 56 of the table apparatus 22. The reward discharged to the player through the discharge 54 depends on the outcome of the game. Depending on the outcome of the game, more than one reward may be discharged to the user through the output 54.

The support system 24 is assembled by engaging a male member, such as rear leg 70 (FIG. 2) with a female member such as front leg 68. The engagement of the rear leg 70 with the front leg 68 is accomplished by inserting an arm 76 rigidly attached to the rear leg 70 into a hollow interior formed within the front leg 68. To further secure the front leg 68 with the rear leg 70, the legs 68 and 70 are placed over the treaded bosses 155. Conventional fasteners 147, 149, and 151 are then threaded into the bosses 155; thus attaching the support system 24 to the table apparatus 22. The front leg 64 and the rear leg 66 of the U-shaped member 60 are secured together in the same manner as the front leg 68 and the rear leg 70 of the U-shaped member 62.

Once the U-shaped members are assembled and mounted onto the table apparatus 22, transverse support members 106 and 108 may be secured to the U-shaped members to provide additional stability to the support system 24. As shown, the transverse support members 106 and 108 may be secured to the U-shaped members 60 and 62 by conventional fasteners 114.

The invention may be embodied in other specific forms without departing from the spirit of essential characteristics thereof the present embodiments, therefore, are to be considered in all respects as illustrative and are not restrictive, the scope of the invention being indicated by the appended claims rather than by the foregoing description, and all changes which come within the meaning and range of equivalency of the claims are therefore intended to be embraced therein.

What is claimed is:

1. A coin-operated machine comprising:

a housing;

an entry mechanism for introduction of coins, each coin having a pre-determined diameter;

a receiving and aligning hopper for coins located below the coin entry mechanism, the hopper comprising an open rectangular top having a length several times the diameter of any of said coins to be passed through the entry mechanism and a width several times the diameter of any said coins to be passed through the entry mechanism;

hopper further comprising a plurality of integrated substantially vertical walls and a single sloped wall upon which all coins fall causing each coin to be disposed at acute angles to the horizontal and the vertical and to slide down the sloped wall by gravity, the hopper also comprising a discharge chute comprising an elongated opening the width of which is substantially less than the diameter of any of said coins and the length of which is several times greater than the diameter of any of said coins into which each coin falls in a generally vertical orientation;

a coin storage box having a coin-receiving slot aligned with the discharge chute of the hopper to receive the generally vertically oriented coins, the coin storage box comprises a topless rectangular coin receptacle comprised of four side walls and a bottom wall and a bottomless removable cover superimposed upon the receptacle and comprised of four side walls and a top walls, the receiving slot being disposed in the top wall of the removable cover;

the topless coin receptacle further comprises a locking mechanism interposed between the coin receptacle and the housing to prevent unauthorized access to the coin storage box;

the locking mechanism comprising a locking/unlocking actuator and a threaded shaft interposed between the actuator and the coin receptacle whereby the actuator may be rotated to unthread the shaft from the receptacle to eject at least in part the coin receptacle from the housing through an opening in the housing.

2. A coin-operated machine comprising a housing;

an entry mechanism for introduction of coins, each coin having a predetermined diameter;

a receiving and aligning hopper for receiving and placing each introduced coin in a generally vertical orientation, the hopper comprising a discharge chute;

a coin storage box having a coin-receiving slot aligned with the discharge chute, the coin storage box comprising a topless rectangular coin receptacle into which coins are deposited and stored comprised of four side walls and a bottom wall and a bottomless removable cover superimposed upon the receptacle and comprised of four side walls and a top wall, the receiving slot being disposed in the top wall of the removable cover through which the generally vertically oriented coins pass to rest upon the bottom wall;

the topless coin receptacle further comprises a locking mechanism interposed between the coin receptacle and the housing to prevent unauthorized access to the coin storage box;

the locking mechanism comprising a locking/unlocking actuator and a threaded shaft interposed between the actuator and the coin receptacle whereby the actuator may be rotated to unthread the shaft from the receptacle to eject at least in part the coin receptacle from the housing through an opening in the housing.

3. A method of displacing coins within a coin-operated machine, comprising the steps of:

inserting coins, each having a predetermined diameter, at a coin entry mechanism;

causing each coin to fall upon and slide down a large sloped single surface by force of gravity, length and width dimensions of the sloped single surface being several times greater than the diameter of any of said coins, each coin obtaining an acute angular orientation with respect to both the horizontal and the vertical by contact and sliding engagement with said large sloped single surface;

causing each sliding angularly oriented coin to pass over a single horizontally-extending edge of the sloped surface and along and out a discharge chute whereby each coin is generally vertical oriented as it passes under force of gravity from the discharge chute;

receiving each generally vertically oriented coin from the discharge chute through a coin slot in a coin storage box aligned with the discharge chute;

the receiving step comprising passing each coin through the coin slot disposed in a bottomless cover of the coin storage box and thence upon a bottom wall of a topless receptacle of the coin storage box and further comprising the steps of removing the coin storage box from the coin-operated machine and accessing the coins in the receptacle by lifting the bottomless cover from the topless receptacle;

the removing step being accompanied by the step of unlocking the coin storage box from a locked relationship with the coin-operated machine;

the unlocking step comprising the steps of unthreading a threaded locking shaft from a threaded connection between a lock mounted to the coin-operated machine and the coin storage box to both displace the coin storage at least partially out of the machine and disconnect the coin storage box from the lock.

4. A method of displacing coins within a coin-operated machine, comprising the steps of:

inserting coins, each having a predetermined diameter, at a coin entry mechanism causing each coin to be received in a hopper, the hopper placing each coin in a generally vertical orientation;

introducing each generally vertically oriented coin through a slot in a bottomless removable cover of a coin storage box directly into a topless coin receptacle only of the coin storage box over which the bottomless removable cover is superimposed;

removing the coin storage box from the coin-operated machine and accessing the coins in the receptacle by lifting the bottomless cover from the topless receptacle;

the removing step being accompanied by the step of unlocking the coin storage box from the coin-operated machine;

the unlocking step comprising the steps of unthreading a threaded locking shaft from a threaded connection between a lock mounted to the coin-operated machine and the coin storage box to both displace the coin storage at leas, partially out of the machine and disconnect the coin storage box from the lock.

* * * * *